United States Patent [19]

Oka et al.

[11] Patent Number: 4,725,533

[45] Date of Patent: Feb. 16, 1988

[54] SILVER HALIDE PHOTOGRAPHIC MATERIAL FOR WASH-OFF RELIEF IMAGE

[75] Inventors: Yutaka Oka; Khotarou Endou, both of Kanagawa, Japan

[73] Assignee: Fuji Photo Film Co., Ltd., Kanagawa, Japan

[21] Appl. No.: 832,795

[22] Filed: Feb. 25, 1986

[51] Int. Cl.[4] ..... G03C 1/06; G03C 1/02

[52] U.S. Cl. ..... 430/566; 430/264; 430/598

[58] Field of Search ..... 430/264, 566, 598

[56] References Cited

U.S. PATENT DOCUMENTS 3,440,049 4/1969 Moede et al. ..... 430/566 X
4,283,479 8/1981 Hamaoka et al. ..... 430/264
4,369,245 1/1983 Beruto et al. ..... 430/566 X
4,504,572 3/1985 Beruto et al. ..... 430/566 X

FOREIGN PATENT DOCUMENTS 2044943 10/1980 United Kingdom ..... 430/264

*Primary Examiner*—Paul R. Michl
*Assistant Examiner*—Mukund J. Shah
*Attorney, Agent, or Firm*—Sughrue, Mion, Zinn, Macpeak, and Seas

[57] ABSTRACT

A silver halide photographic material forming a wash-off relief image comprising a support having provided thereon a layer containing a tanning developing agent such as catechol, hydroquinone or pyrogallol, emulsified and dispersed in a high boiling point solvent such as butyl phthalate, butyl benzoate or tricreryl phosphate, and a layer containing a silver halide direct reversal emulsion.

10 Claims, No Drawings

SILVER HALIDE PHOTOGRAPHIC MATERIAL FOR WASH-OFF RELIEF IMAGE

FIELD OF THE INVENTION

This invention relates to a silver halide photographic material and, more particularly, to a silver halide direct reversal photographic material capable of forming a wash-off relief image with excellent image quality.

BACKGROUND OF THE INVENTION

Wash-off process light-sensitive materials are materials for forming so-called relief images. The relief images are formed by developing an exposed wash-off process light-sensitive material with a tanning developing agent incorporated therein to thereby harden only the exposed portions of the light-sensitive layer, with the unexposed portions being not hardened, and then washing the developed light-sensitive surface to wash off the unexposed portions, with leaving the exposed portions as a relief.

Conventionally known silver halide direct reversal emulsions contain silver halide grains previously provided with fogging nuclei in an optical or chemical manner. However, when a tanning developing agent is incorporated in these emulsions, the fogging nuclei previously provided therein are destroyed by the developing agent during the period before being coated on a support or during storage after being coated. Thus, preparation of practical products is extremely difficult.

Even when a layer containing a tanning developing agent is provided adjacent to an emulsion layer so as to prevent destruction of fogging nuclei by the tanning developing agent as described above, the fogging nuclei are still destroyed during storage after being coated on a support. Thus, products with good preservability have been difficult to prepare.

SUMMARY OF THE INVENTION

An object of the present invention is to provide a wash-off process light-sensitive material which contains a silver halide direct reversal emulsion having previously been provided with fogging nuclei and a tanning developing agent, said fogging nuclei not being destroyed by the tanning developing agent during the period before coating the emulsion on a support or during storage after coating on a support.

This and other objects of the present invention will become apparent from the following description thereof.

The above described and other objects of the present invention are attained by a light-sensitive material comprising a support having provided thereon a layer containing a tanning developing agent emulsified and dispersed in a high boiling solvent and a layer containing a silver halide direct reversal emulsion.

DETAILED DESCRIPTION OF THE INVENTION

As the tanning developing agent to be used in the present invention, there are illustrated catechol, 4-phenylcatechol, hydroquinone, pyrogallol, and the compound represented by the following formula:

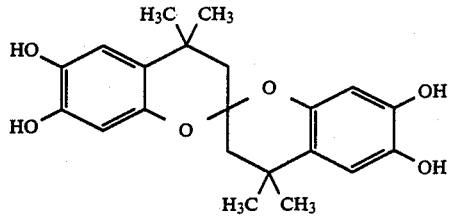

,etc. Further, there are illustrated those described in U.S. Pat. Nos. 2,592,368, 2,685,510, 3,143,414, 2,751,295, 3,440,049, etc. In the case of incorporating these tanning developing agents in light-sensitive materials, they are incorporated in an amount of preferably 0.001 to 1 mol, particularly preferably 0.01 to 0.3 mol, per mol of silver halide in the light-sensitive layer.

As the high boiling point solvents to be used in the present invention, those high boiling point organic solvents for dispersing couplers which are described in U.S. Pat. No. 3,676,137, such as butyl phthalate, dinonyl phthalate, butyl benzoate, diethylhexyl sebacate, butyl stearate, dinonyl maleate, tributyl citrate, tricresyl phosphate, dioctylbutyl phosphate, trihexyl phosphate, trioctadecyl phosphate, etc., diethyl succinate, dioctyl adipate, 3-ethylbiphenyl, and oligo esters as described in Japanese patent application (OPI) No. 104329/81 (the term "OPI" as used herein refers to a "published unexamined Japanese patent application"). These high boiling point solvents are used in an amount of preferably 10 to 1,000 wt %, particularly preferably 50 to 500 wt %, based on the developing agent.

Preferably the developing agent to be used in the present invention is completely dissolved in the high boiling solvent as described above to protect the developing agent with the high boiling solvent, and then the resulting solution is added to a solution of protective colloid (for example, gelatin), followed by dispersing in a colloid mill, a homogenizer, a dissolver, etc. In dissolving the developing agent in the high boiling solvent, a low boiling solvent such as methyl acetate, ethyl acetate, methyl ethyl ketone, cyclohexanone, etc., may be added together with the high boiling solvent for facilitating dissolution of the developing agent. These low boiling solvents are used in an amount of 0.5 to 50 ml per 1 g of the developing agent. In addition, a surfactant such as saponin or alkylnaphthalenesulfonate may be added to the aqueous gelatin solution for improving stability of the high boiling emulsion. These surfactants are used in an amount of 0.02 to 2 ml per 1 g of the developing agent.

In the present invention, the layer containing the tanning developing agent does not contain a light-sensitive silver halide emulsion. This layer may be provided between the support and the direct reversal emulsion layer or on the direct reversal emulsion layer.

The developing agent-containing layer may or may not be adjacent to the direct reversal emulsion layer.

The direct reversal silver halide emulsion to be used in the present invention is an emulsion prepared by dispersing silver halide such as silver chloride, silver chlorobromide, silver chlorobromoiodide, silver bromide, silver bromoiodide, etc., in a protective colloid layer. Such emulsions are prepared by various processes such as a neutral process, an ammonia process, an acid process, or a process of using a thioether solvent as described in U.S. Pat. No. 3,574,628, etc.

Primitive emulsions to be used for the direct reversal silver halide photographic material in accordance with the present invention are grouped into the following two types. One type of emulsion possesses silver halide grains which contain nuclei in an internal portion thereof capable of trapping free electrons and whose surface is optically or chemically fogged. This type of emulsion is characterized in that it directly provides positive images. It can be sensitized in an intrinsic absorption region as well as other spectral regions by the spectrally sensitizing technique using sensitizing dyes. The free electron-trapping nuclei of this type of emulsion are formed by using preferably salts of the group VIII metals.

Another type of emulsion is an emulsion which contains silver halide grains whose surface is chemically fogged without being given free electron-trapping nuclei in an internal portion thereof. This type of emulsion does not provide any direct positive images, but can provide direct positive images with the aid of an organic desensitizing agent.

The emulsions containing the electron-trapping nuclei are described in Japanese patent publication Nos. 4125/68 and 29405/68, U.S. Pat. Nos. 2,976,149 and 3,023,102, British patent Nos. 707,704 and 1,097,999, French patent Nos. 1,520,824 and 1,520,817, and Belgian patent Nos. 713,272, 721,567 and 681,768.

The emulsions not containing the electron-trapping nuclei, and the desensitizing agents are described in British patent Nos. 1,186,717, 1,186,714, 1,186,716, 1,520,817, U.S. Pat. Nos. 3,501,306, 3,501,307, 3,501,810, 3,531,288, etc.

Either of the above described two types of emulsions may be used in the present invention.

As is described hereinbefore, the silver halide photographic emulsion to be used in the present invention is previously fogged by light or chemical means. The emulsion may be chemically fogged by using such fogging agents as hydrazine derivatives, thiourea dioxide, formalin, dimethylamineborane, stannous chloride, etc. The emulsion may also be fogged by using metals electrically more positive than silver such as rhodium, gold, platinum, iridium, etc. The degree of fogging direct reversal silver halide emulsion can be widely varied depending upon the kind and concentration of a fogging agent used, pH and pAg of the emulsion upon fogging, temperature and time, as well as the composition and grain size of silver halide used. In the practice of fogging the emulsion, reference may be made to U.S. Pat. Nos. 3,867,149 and 3,062,651, U.S. Reissued Pat. Nos. 29,930 and 29,974, etc.

These direct reversal silver halide emulsions are used in the light-sensitive materials in a silver amount of preferably 0.1 to 10 g/m$^2$, particularly preferably 0.5 to 4 g/m$^2$.

The silver halide photographic material of the present invention has, on a support, at least one silver halide emulsion layer and at least one tanning developing agent emulsion layer. If desired, it may possess a subbing layer, an interlayer, an antihalation layer, or a surface protecting layer.

To the silver halide photographic emulsion to be used in the present invention may be added various compounds known as photographic additives by, for example, *Research Disclosure,* Vol. 176, pp. 22–31 (December, 1978). Stabilizers such as mercapto compounds, tetrazaindenes, etc., and coating aids such as natural surfactants (e.g., saponin), nonionic surfactants (e.g., alkylene oxides, glycidols, etc.), anionic surfactants containing acidic groups such as carboxylic acid, sulfonic acid, phosphoric acid, sulfuric esters, phosphoric esters, etc.), and amphoteric surfactants (e.g., amino acids, aminosulfonic acids, etc.), and polyalkylene oxide compounds also functioning as toe cutting agents in lithographic development may be incorporated. These stabilizers are used in an amount of 1 to 100 mg/m$^2$ and these coating aids are used in an amount of 0.01 to 1 g/m$^2$. In addition, a dispersion of a water-insoluble or slightly water-soluble synthetic polymer may be incorporated for the purpose of improving dimensional stability. For example, alkyl (meth)acrylates, alkoxyalkyl (meth)acrylates, (meth)acrylamides, vinyl esters (e.g., vinyl acetate, etc.), acrylonitrile, etc., may be used alone or as a combination thereof. These compounds for the purpose of improving dimensional stability are used in an amount of 1 to 10 g/m$^2$.

As the support, there are illustrated polyester films such as polyethylene terephthalate film, cellulose ester films such as cellulose acetate film and cellulose acetate butyrate film, polycarbonate films, etc. Of these, polyester films having good dimensional stability are preferably used.

The support may have a matting layer thereon and, as the matting agent, silicon dioxide and titanium dioxide are preferable. These matting agents are used in an amount of 1 to 20 g/m$^2$. As the binder of the matting layer, polymethyl methacrylate, methyl methacrylate copolymers, nitrocellulose, vinylidene chloride copolymer, cellulose acetate, polyesters, etc., may be used.

In the present invention an antihalation layer is preferably provided between the support and the silver halide emulsion layer. The antihalation layer may contain, in addition to the hydrophilic protective colloid such as gelatin, dyes as well as carbon black or colloidal silver as light absorbing substances. However, carbon black or colloidal silver is particularly preferably used. These light absorbing substances are used in an amount of 0.01 to 1 g/m$^2$.

Development processing employed in the present invention differs from a conventional black-and-white development processing only in that the developing bath is an alkaline activator bath.

The pH of the activator bath is selected between about 7 and about 14, with pH of 12 to 14 being preferable.

The processing temperature of the activator bath is selected between 5° C. and 30° C., with 13° C. to 20° C. being preferable.

The activator bath to be employed in the present invention has fundamentally the same formulation as ordinary black-and-white developers except for omitting developing agents. As the pH buffers of the activator solution, sodium hydroxide, potassium hydroxide, sodium carbonate, potassium carbonate, sodium or potassium tertiary phosphate, potassium metaborate, borax, etc., are used alone or in combination. In addition, various salts such as disodium or dipotassium hydrogenphosphate, sodium or potassium dihydrogenphosphate, sodium or potassium bicarbonate, boric acid, alkali nitrate, alkali sulfate, etc., may be used for obtaining a further buffer function, for the convenience of the preparation of the activator solution, for increasing the ionic strength, etc. These pH buffers are used in an amount of 50 to 500 g/l.

Fog inhibitors may also be incorporated into the activator bath to be employed in the present invention in an amount of 0.1 to 10 g/l. Such fog inhibitors include inorganic halide compounds and known organic antifogging agents. Typical examples of the inorganic halide compounds are bromides such as sodium bromide, potassium bromide or ammonium bromide and iodides such as potassium iodide or sodium iodide. On the other hand, examples of the organic antifogging agents include 6-nitrobenzindazoles described in U.S. Pat. No. 2,496,940, 5-nitrobenzimidazoles described in U.S. Pat. Nos. 2,497,917 and 2,656,271, diaminophenazine, o-phenylenediamine, mercaptobenzimidazole, methylbenzothiazole, mercaptobenzoxazole, thiouracil and 5-methylbenzotriazole described in *J. of the Soc. of Photo. Sci. and Tech. of Japan,* Vol. 11, p. 48 (1948), and the heterocyclic compounds described in Japanese patent publication No. 41675/71. Further, antifogging agents described in *Kagaku Shashin Binran,* Vol. II, p. 119 (published by Maruzen in 1959) may also be used.

Development inhibitors known by Japanese patent publication Nos. 19039/71 and 6149/70, U.S. Pat. No. 3,295,976, etc., may be used in the activator bath to be employed in the present invention for controlling development of the surface layer. These development inhibitors are used in an amount of 0.1 to 10 g/l.

If necessary, ammonium chloride, potassium chloride, sodium chloride, etc., may also be added to the activator bath to be employed in the present invention. Any development accelerator may be used together in the activator bath to be employed in the present invention, if desired. Among the development accelerators are various pyridinium compounds and other cationic compounds represented by those described in U.S. Pat. No. 2,648,604, Japanese patent publication No. 9503/69, U.S. Pat. No. 3,671,247, etc., cationic dyes such as phenosafranine, neutral salts such as thallium nitrate and potassium nitrate, nonionic compounds such as polyethylene glycol and the derivatives thereof, and polythioethers described in Japanese patent publication No. 9504/69, U.S. Pat. Nos. 2,533,990, 2,531,832, 2,950,970 and 2,577,127, organic solvents and organic amines, ethanolamine, ethylenediamine, diethanolamine, etc., described in Japanese patent publication No. 9509/69 and Belgian patent No. 682,862. In addition, there are included those accelerators which are described in detail in L.F.A. Mason, *Photographic Processing Chemistry,* pp. 40–43 (Focal Press, London, 1966).

Still further, sodium sulfite, potassium sulfite, potassium hydrogensulfite, sodium hydrogensulfite, etc., may be added to the activator bath to be employed in the present invention.

Still further, polyphosphate compounds exemplified by sodium hexametaphosphate, sodium tetrapolyphosphate, sodium tripolyphosphate, potassium hexametaphosphate, potassium tetrapolyphosphate, potassium tripolyphosphate, etc., and aminopolycarboxylic acids exemplified by ethylenediaminetetraacetic acid, nitrilotriacetic acid, cyclohexanediaminetetraacetic acid, iminodiacetic acid, N-(hydroxymethyl)ethylenediaminetriacetic acid, diethylene triaminepentaacetic acid, etc., may be used as water softeners. The amounts of these softeners to be added vary depending upon the hardness of water used, but are usually about 0.5 to 10 g/l. In addition, a calcium or magnesium type masking agent can also be used. These are described in detail in J. Willems, *Belgisches Chemiches Industry,* 21, p. 325 (1956) and 23, p. 1105 (1958).

The present invention is now described in greater detail by reference to the following example which, however, is not to be construed as limiting the present invention in any way.

EXAMPLE 1

Sample (1) Preparation of a developing agent emulsion:

| | |
|---|---|
| Solution I | |
| Developing Agent (Compound I) | 20 g |
| Adipic Acid-Diethylene Glycol Copolymer | 140 g |
| Ethyl Acetate | 90 g |
| Solution II | |
| Gelatin | 85 g |
| Water | 600 g |
| Saponin (6 wt % aq. soln.) | 60 g |

Compound I

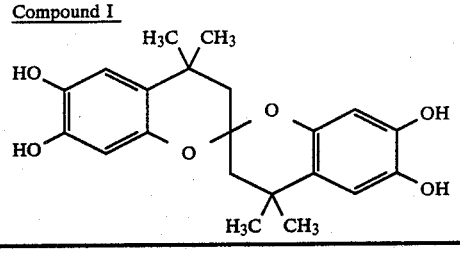

Solution I and Solution II were mixed at a temperature of 60° C. with each other and, after stirring for 5 minutes in a high speed dissolver, the mixture was cooled to prepare an emulsion.

(2) Preparation of a silver halide direct reversal emulsion:

A silver halide emulsion containing 23 g of gelatin and 1.1 mol of silver bromide in 1,000 g of water was prepared. Silver bromide grains thus formed had a mean grain size of 0.3 μm.

This emulsion was freed of soluble salts by a flocculation method, and then 50 g of gelatin was added thereto, followed by formation of fogging nuclei with hydrazine in an amount of 0.26 mg per 1 kg of silver.

(3) Preparation of a coating solution for forming antihalation layer:

| | |
|---|---|
| Gelatin | 40 g |
| Carbon Black | 15 g |
| Water | 1 l |

(4) Preparation of light-sensitive material:

A matting layer containing $SiO_2$ and $TiO_2$ as matting agents and polymethyl methacrylate and nitrocellulose as binders was provided on a polyester film (100 μm thick) and, after providing a gelatin interlayer (0.2 μm thick) on the matting layer, the above described coating solution for forming an antihalation layer was coated in an amount of 0.1 g of carbon black per $m^2$.

Sample A was prepared by coating thereon the aforesaid emulsion in an amount of 0.3 g of the developing agent (Compound I) per $m^2$, and coating thereon the aforementioned silver halide direct reversal emulsion having previously formed fogging nuclei in an amount of 1.5 g of silver per $m^2$, followed by drying.

Sample B was prepared by using the same developing agent emulsion and the same silver halide emulsion as with Sample A having been stored for 6 hours at 40° C. under stirring, and coating them as separate layers in the same manner as with Sample A.

Samples C and D were prepared as follows. The developing agent emulsion and the silver halide emulsion were previously mixed with each other in the developing agent (Compound I) to silver ratio of 1:5, and stored at 40° C. under stirring. After 1 hour mixing (Sample C) or 6 hour mixing (Sample D), the mixture was coated as one layer on a polyester film coated with the aforementioned antihalation layer in an amount of 0.3 g of the developing agent (Compound I) per $m^2$ and 1.5 g of silver per $m^2$.

Samples E and F were prepared as follows. A methanol solution of the developing agent (Compound I) was directly added to the silver halide emulsion in a developing agent to silver ratio of 1:5. After 1 hour (Sample E) or 6 hours (Sample F), the mixture was coated as one layer on a polyester film coated with the aforementioned antihalation layer in an amount of 0.3 g of the developing agent (Compound I) and 1.5 g of silver per $m^2$.

Test

Samples A, B, C, D, E and F were left for one day under the conditions of 50° C. in temperature and 70% in relative humidity to conduct incubation. Each sample, both incubated and non-incubated, was exposed to light which was obtained using 1 kw high pressure mercury lamp and which was passed through a step wedge of 0.1 in density difference for 15 seconds, and then soaked in an activator solution of the following formulation at 20° C. for 10 seconds, followed by washing off the emulsion surface with a 40° C. water.

| | |
|---|---|
| $K_2CO_3$ | 100 g |
| KOH | 25 g |
| $K_2SO_3$ | 2 g |
| Benzotriazole | 0.4 g |
| Water to make | 1 l |

The sensitivity of each sample was relatively evaluated in terms of the minimum exposure amount necessary for washing off the emulsion surface. The results thus obtained are tabulated in the Table below.

TABLE

| | Sample | | | | | | | | | | | |
|---|---|---|---|---|---|---|---|---|---|---|---|---|
| | A | B | C | D | E | F | A | B | C | D | E | F |
| Relative Sensitivity (Δlog E) | 0 | 0 | −0.2 | −0.6 | −1.0 | *1 | 0 | 0 | −0.3 | −1.0 | *1 | *1 |
| Incubation of Coated Sample | Not Conducted | | | | | | Conducted | | | | | |

*1 No reversal images were obtained.

As is seen from the above Table, Samples A and B prepared by coating the developing agent emulsion layer and the silver halide emulsion layer as different layers underwent no reduction in relative sensitivity and showed good image quality in comparison with Samples C and D prepared by coating a mixture of the developing agent emulsion and the silver halide emulsion and Samples E and F prepared by directly adding the developing agent to the silver halide emulsion.

The same results were obtained with light-sensitive materials prepared by changing the order of the developing agent emulsion layer and the silver halide emulsion layer.

While the invention has been described in detail and with reference to specific embodiments thereof, it will be apparent to one skilled in the art that various changes and modifications can be made therein without departing from the spirit and scope thereof.

What is claimed is:

1. A silver halide photographic material forming a wash-off relief image, which comprises a support having provided thereon a layer containing a tanning developing agent emulsified and dispsersed in a high boiling point solvent and a layer containing a silver halide direct reversal emulsion but excluding tanning developing agents, wherein said layer containing a tanning developing agent is provided between the support and the direct reversal emulsion layer or on the direct reversal emulsion layer.

2. The silver halide photographic material as claimed in claim 1, wherein said tanning developing agent is selected from the group consisting of catechol, 4-phenylcatechol, hydroquinone, pyrogallol and the compound represented by the following formula:

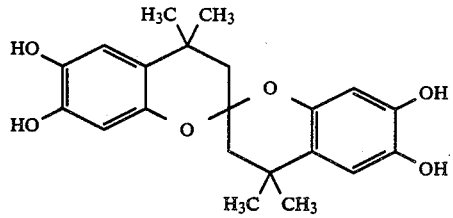

and said tanning developing agent is employed in an amount of from 0.001 to 1 mol per mol of silver halide in the light-sensitive material.

3. The silver halide photographic material as claimed in claim 2, wherein said tanning developing agent is employed in an amount of from 0.01 to 0.3 mol per mol of silver in the light-sensitive material.

4. The silver halide photographic material as claimed in claim 1, wherein said high boiling point solvent is selected from the group consisting of butyl phthalate, dinonyl phthalate, butyl benzoate, diethylhexyl sebacate, butyl stearate, dinonyl maleate, tributyl citrate, tricresyl phosphate, dioctylbutyl phosphate, trihexyl phosphate, trioctadecyl phosphate, diethyl succinate, dioctyl adipate, 3-ethylbiphenyl and oligo esters.

5. The silver halide photographic material as claimed in claim 1, wherein said high boiling point solvent is employed in an amount of from 10 to 1,000 wt % based on the developing agent.

6. The silver halide photographic material as claimed in claim 4, wherein said high boiling point solvent is employed in an amount of from 50 to 500 wt % based on the developing agent.

7. The silver halide photographic material as claimed in claim 1, wherein the direct reversal silver halide emulsion is employed in an amount of 0.1 to 10 $g/m^2$ based on the amount of silver.

8. The silver halide photographic material as claimed in claim 7, wherein the direct reversal silver halide emulsion is employed in an amount of 0.5 to 4 $g/m^2$ based on the amount of silver.

9. The silver halide photographic material as claimed in claim 1, wherein said tanning developing agent is emulsified and dispersed in a mixture of said high boiling point solvent and a low boiling point solvent wherein said high boiling point solvent is employed in an amount of from 10 to 1,000 wt % based on the developing agent and said low boiling point solvent is present in an amount of 0.5 to 50 ml per g of the developing agent.

10. The silver halide photographic material as claimed in claim 9, wherein said low boiling point solvent is selected from the group consisting of methylacetate, ethylacetate, methylethylketone, and cyclohexanone.

* * * * *